US006216626B1

(12) United States Patent
Curtis

(10) Patent No.: US 6,216,626 B1
(45) Date of Patent: Apr. 17, 2001

(54) FLOW RELEASE ELASTOMERIC EJECTION SYSTEM

(75) Inventor: Clifford M. Curtis, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/287,170

(22) Filed: Apr. 2, 1999

(51) Int. Cl.[7] ..... B63B 1/00
(52) U.S. Cl. ..... 114/238; 138/30
(58) Field of Search ..... 138/30, 31; 114/238, 114/318, 319

(56) References Cited

U.S. PATENT DOCUMENTS 4,335,751 * 6/1982 Sugimura et al. ..... 138/30
4,351,363 * 9/1982 Haug et al. ..... 138/30
4,705,077 * 11/1987 Sugimura ..... 138/30
4,784,181 * 11/1988 Hilverdink ..... 138/30
4,848,210 * 7/1989 Bissonnette ..... 89/1.81
5,027,859 * 7/1991 Sugimura ..... 138/30
5,085,122 * 2/1992 Berlam et al. ..... 89/1.8
5,200,572 * 4/1993 Bissonnette et al. ..... 89/1.81
5,231,241 * 7/1993 Bissonnette ..... 89/1.81
5,370,033 * 12/1994 Bitsakis et al. ..... 89/1.81
5,410,978 * 5/1995 Waclawik et al. ..... 114/238
5,645,006 * 7/1997 Moody ..... 114/238

* cited by examiner

*Primary Examiner*—Michael J. Carone
*Assistant Examiner*—Denise J Buckley
(74) *Attorney, Agent, or Firm*—Michael J. McGowan; James M. Kasischke; Prithvi C. Lall

(57) ABSTRACT

An apparatus for providing a rapid fluid impulse which can be used for launching vehicles into a liquid medium. The apparatus comprises a ring diaphragm of coupled concentric elastomeric rings, adapted to accept pressurized fluid at an interior side. The pressurized fluid extends the elastomeric rings of the ring diaphragm, placing them in shear strain. When the fluid is released, a kinetic impulse is provided and the ring diaphragm returns to its resting position. The apparatus further comprises a central check valve on the ring diaphragm. The check valve allows fluid to flow from an exterior side, through the ring diaphragm, to the interior side when exterior fluid pressure exceeds interior pressure. The invention is useful in a submarine vehicle launch assembly wherein the ring diaphragm is a component thereof.

16 Claims, 1 Drawing Sheet

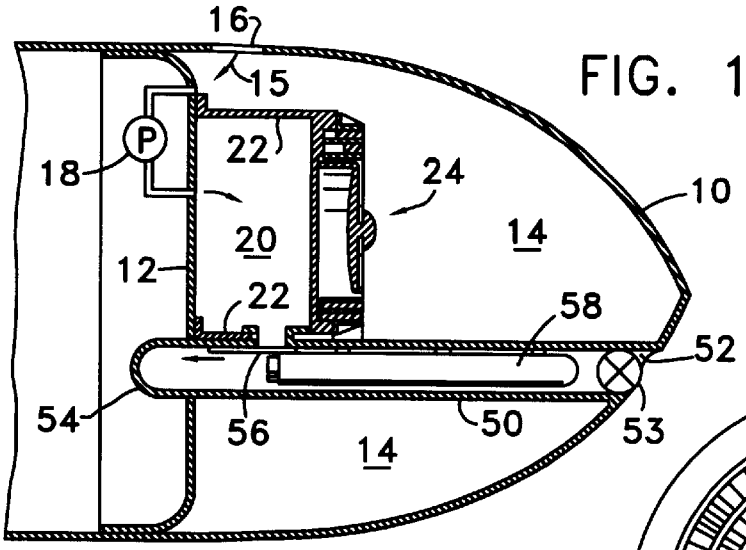
FIG. 1
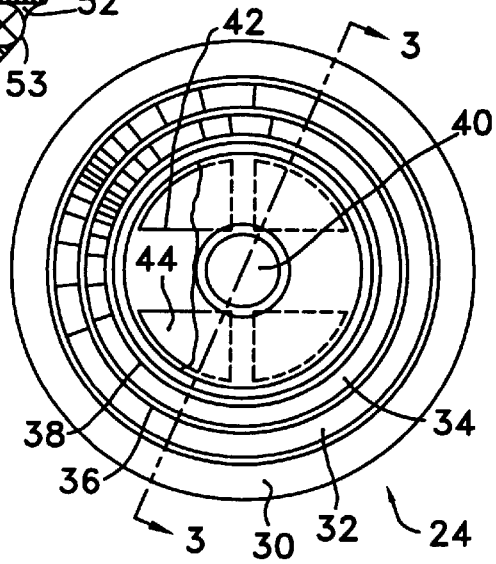
FIG. 2
FIG. 3
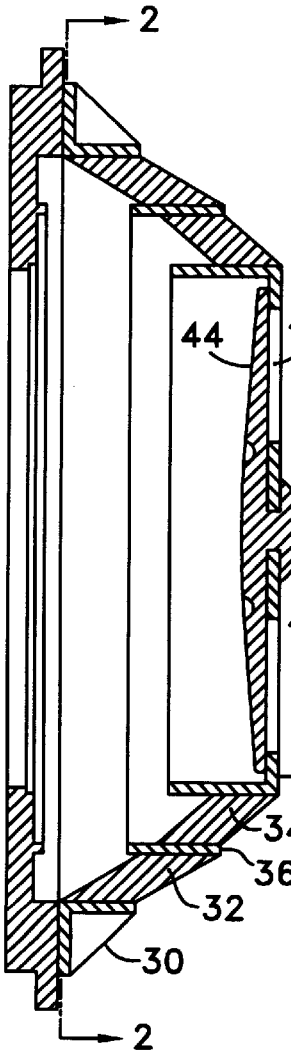
FIG. 4
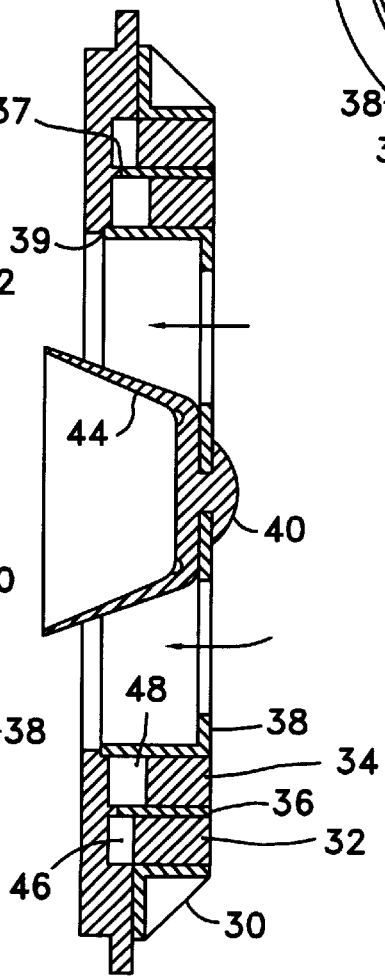

FLOW RELEASE ELASTOMERIC EJECTION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to an elastomeric vehicle launching system, and more particularly to a low noise, low volume, low elastomeric strain impulse fluid delivery apparatus of concentric elastomeric rings.

2. Description of the Prior Art

Impulse fluid flows are used to launch vehicles from submarine platforms. Launch systems in the prior art include the single stroke reciprocating pump, and the rotary air turbine pump. Additionally, elastomeric ejection systems have been developed, which store impulse fluid in charged el-astomeric bladders.

The single stroke reciprocating pump converts pneumatic potential energy from compressed air stored in a flask into working fluid kinetic energy. The pump utilizes a massive piston apparatus to transfer sufficient working fluid, such as seawater, to launch a projectile. The system has proven reliable, but has significant disadvantages. Its complexity results in high system and maintenance cost, and the rapid conversion of pneumatic potential energy into the vehicle kinetic energy results in significant radiated noise.

The air rotary turbine pump also converts potential energy in the form of compressed air stored in a flask into kinetic energy of a working fluid. An air turbine drive unit is joined with a rotary impeller pump via a speed reduction unit. This system suffers from disadvantages similar to those of the single stroke reciprocating pump. An alternative type of launch system is the elastomeric ejection system (EES) which addresses the problems of the single stroke reciprocating pump and the air rotary turbine pump. U.S. Pat. No. 4,848,210 discloses a n elastomeric impulse energy storage and transfer system. The system of this patent is adapted to a torpedo launch system wherein an elastomeric bladder is distended by filling it with pressurized fluid. When a fluid impulse is desired, the elastomeric bladder discharges its volume of working fluid to eject a projectile from the launch system into the surrounding liquid. The elastomeric bladder used is generally spherical, containing an expanded volume sufficient to fill the launch tube and the launch way forward of the launch tube.

U.S. Pat. No. 5,200,572 discloses an EES bladder, which has an elevation of frusto-ellipsoidal configuration and an ellipsoidal sectional plane parallel to the base of the bladder. The bladder of this patent is aimed at achieving a smooth and even flow of impulse fluid from the bladder to further reduce radiated noise.

U.S. Pat. No. 5,231,241 further discloses an EES configuration in which a submarine hull partially defines the volume of fluid stored in the elastomeric bladder. An impulse tank is defined by the volume between the inner hull and an elastomeric sheet. Pressurized liquid causes the diaphragm to expand within the outer hull to generate the required potential energy for a launch. U.S. Pat. No. 5,231,241 is hereby incorporated by reference.

The above EES systems suffer from cavitation noise following launch. When the finite volume of fluid in the bladder is exhausted a low pressure region forms, causing cavitation on the inside surface of the elastomeric bladder. U.S. Pat. No. 5,410,978 discloses a flow-through EES aimed at preventing cavitation noise. A cylindrical elastomeric bladder is disposed within a bypass tube, open at one end. When the bladder is filled with fluid, the walls of the bladder contact the walls of the bypass tube at a sealing ring, sealing the system from the outside fluid atmosphere. When the fluid in the bladder is discharged, the bladder unseats from the bypass tube, allowing free flow of fluid from the outside fluid atmosphere toward the impulse fluid.

Another patent further illustrative of the art is U.S. Pat. No. 5,645,006 which discloses a bladder assembly for retaining fluid under pressure.

A primary disadvantage of prior art EES systems is the high level of elastic strain on the charged bladder resulting in unstable bladder geometry and reduced material cyclic life. A further disadvantage is the undesirable cavitation noise which can occur following launch. Another disadvantage is that large bladder volumes are required to ensure successful vehicle launch before a bladder is exhausted. Further, the prior art flow through EES also suffer from undesirable system complexity.

SUMMARY OF THE INVENTION

Accordingly, it is a general purpose and primary object of the present invention to provide an improved elastomeric ejection system (EES) for delivering impulse fluid to a vehicle.

A primary object of the invention is to provide a low volume launch system, which produces a minimal amount of radiated noise.

A further object of the invention is to provide a system with a long material cyclic life.

A still further object of the invention is to provide a mechanically simple, low cost EES.

In furtherance of the purpose and objects of the invention, a flow release elastomeric ejection apparatus and assembly are provided, featuring a ring-type diaphragm of concentric elastomeric rings, able to accept pressurized fluid and storing elastic potential energy in shear strain.

The ring diaphragm of the assembly comprises a series of concentric elastomeric rings, coupled to one another and alternating with rigid rings. These rings radiate inward toward a central disc to form an impermeable diaphragm. The ring diaphragm is adapted to be incorporated within a launch system such that pressurized fluid can be presented to an inner side of the diaphragm. Thus, the diaphragm is placed across an opening between two separate volumes of fluid. For example, the ring diaphragm can be attached such that it partially defines an impulse tank. When fluid pressure is increased on the inner side of the ring diaphragm, the elastomeric rings deform in shear strain to accept the additional fluid. Potential energy for launch is stored in the strained rings. Fluid release provides the impulse energy required for a launch and allows the ring diaphragm to return to its resting position.

A preferred flow release aspect of the invention comprises a one-way central check valve, which is a modified central disc. The check valve includes cut-outs in the central disc and valve flaps having seated and open positions in relation to the cut-outs. Following launch, excess fluid pressure on an outer side of the ring diaphragm causes the valve flaps to unseat and swing open, allowing fluid to flow through the ring diaphragm behind the impulse fluid. The resulting fluid pressure equilibration across the ring diaphragm prevents cavitation noise and makes a smaller impulse fluid volume feasible.

A further aspect of the present invention is an integrated vehicle launch assembly including the ring diaphragm of the invention. The ring diaphragm partially defines an impulse tank within the outer hull of a submarine. A pump transfers fluid from a free flood area to charge the impulse tank and the ring diaphragm. Launch is achieved by opening a slide valve connecting the impulse tank to a launch tube containing the launch vehicle. As the ring diaphragm deflates, the impulse fluid flows from the impulse tank into the launch tube forcing the vehicle out of the launch tube. Following launch, the check valve is forced open by fluid pressure in the free flood area, allowing fluid to flow from through the ring diaphragm into the impulse tank and toward the launch tube.

The ring diaphragm of the present invention will provide a long material cyclic life because the elastomeric rings are placed in shear strain (as opposed to extension), thereby subjecting the material to milder levels of strain than required of prior art elastomeric bladders. Further, the check valve feature of the invention prevents noisy cavitation by allowing free flow of fluid through the ring diaphragm from outside after launch. The check valve also makes possible a low overall system volume, because rapid deceleration of the impulse fluid is avoided. The central check valve is an optional but preferred feature of the invention, and additionally, the number of concentric rings in the accumulator may be modified.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein:

FIG. 1 is a sectional diagrammatic view of the bow of a submarine showing a vehicle launch assembly including the ring diaphragm of the present invention in its resting position;

FIG. 2 is an enlarged top plan view of the ring diaphragm of the invention showing, among other features, the concentric rings and the central check valve shown in partial cutaway;

FIG. 3 is an enlarged cross-sectional view along lines 3—3 of the ring diaphragm shown in FIG. 2, depicting the ring diaphragm in its fully charged position; and FIG. 4 is a view of the ring diaphragm shown in FIG. 3 depicting the ring diaphragm in its flow release position.

DESCRIPTION OF THE PREFERRED EMBODIMENT

Referring now to FIG. 1, there is shown a diagrammatic view of the bow of a submarine, cut away to display an illustrative launch assembly in accordance with the present invention.

The outer hull 10 and the inner hull 12 of the bow define a free flood area 14 which is open to outside seawater through one or more openings 16 in the outer hull 10. A pump 18 is provided within the inner hull and has a suction side, adapted to draw fluid from the free flood area 14, and a discharge side to inject pressurized fluid into an impulse tank 20.

Impulse tank 20 is defined by the submarine inner hull 12, impulse tank walls 22 extending from inner hull 12, and a ring diaphragm 24. Ring diaphragm 24 is shown in FIG. 1 in its resting position.

Referring to FIG. 2, a top plan view of ring diaphragm 24 is shown. Outer base ring 30 supports the ring diaphragm and secures it to the walls 22 of impulse tank 20. Radiating inward from the base ring 30 is a series of two elastomeric rings 32 and 34, alternating with two rigid steel rings 36 and 38. At the center of ring diaphragm 24 is central check valve 40 (shown in partial cutaway) with four flow release cutouts 42 and valve flaps 44. The elastomeric rings 32 and 34 can be of neoprene, natural rubber, or the like.

Returning to FIG. 1, a launch tube 50 has a breach end 54 and a mouth 52 containing muzzle valve 53. The launch tube 50 communicates with impulse tank 20 when a flow controlling slide valve 56 is moved to its open position. With the slide valve 56 closed, the impulse tank 20 can be charged. The submarine utilizes fluid in free flood area 14, provided through an opening 16 in outer hull 10. The fluid is drawn in by pump 18, as indicated by the arrow 15, so as to charge the impulse tank 20 and to cause the elastomeric rings 32 and 34 of ring diaphragm 24 to deform in shear strain.

Referring to FIG. 3, a sectional view of ring diaphragm 24 taken along 3—3 of FIG. 2 illustrate the ring diaphragm in its fully charged position. Increased pressure in the impulse tank 20 causes elastomeric rings 32 and 34 to deform in shear strain to accept the pressurized fluid being added. When pressure in impulse tank 20 exceeds pressure in free flood area 14, check valve 40 is closed. Valve flaps 44 are seated against flow release cutouts 42, preventing escape of fluid from the impulse tank 20. The amount of displacement permitted by the elastomeric rings 32, 34 is controlled by the charged volume of the impulse tank 20. The required potential fluid energy can be stored at below 50% shear strain.

Returning to FIG. 1, a fluid impulse can be delivered from the charged impulse tank 20 to launch tube 50 by opening slide valve 56. This fluid impulse ejects launch vehicle 58 from the submarine.

As the impulse fluid is discharged, elastomeric rings 32 and 34 begin to return to the resting state. Referring to FIG. 4, a sectional view of ring diaphragm 24 in its flow release position is shown. Displacement stops 37 and 39, which extend from impulse tank walls 22, are positioned in the path of rings 36 and 38. The displacement stops 37, 39 halt the motion of the deflating ring diaphragm 24, preventing a reversal and maintaining a slight positive shear strain in the elastomeric rings 32 and 34 so that crystalline structures within the elastomer will resist crack propagation. Displacement stops 37 and 39 are constructed in a step-down configuration such that displacement stop 39 permits a slightly larger range of motion than does displacement stop 37.

As further shown in FIG. 4, when rigid rings 36 and 38 contact displacement stops 37 and 39, dashpot cavities 46 and 48 are created. The rigid rings 36 and 38 trap an amount of fluid within the cavities, causing a smooth and quiet arrest to rings 36 and 38 against stops 37 and 39.

Returning again to FIG. 1, it is noted that the discharge of pressurized fluid from impulse tank 20 can create a pressure differential such that fluid pressure in the free flood area 14 is higher than that in launch tube 50 and impulse tank 20. Without equilibration, noisy cavitation can occur on the surface of the ring diaphragm 24.

As shown in FIG. 4, central check valve 40 is in its flow release position. Higher fluid pressure in free flood area 14 holds valve flaps 44 open, allowing fluid to enter the impulse tank 20 through cut-outs 42, and flow toward the launch tube 50. Thus, cavitation is prevented. The flow release feature also permits a smaller impulse fluid volume, because rapid deceleration of flow is avoided. This in turn results in shorter recharge times. The central location of the check valve has the advantage of providing a smoother flow through the system than a peripheral valve would permit. Additionally, the integrated valve/ring configuration of ring diaphragm 24 provides a mechanically simple ejection system. Once equilibration has occurred, impulse tank 20 is ready for recharging.

In light of the above, it is therefore understood that within the scope of the appended claims, the invention may be practiced otherwise than as specifically described.

What is claimed is:

1. An elastomeric ring diaphragm for storing and delivering pressurized fluid to a component comprising:

at least one elastomeric ring;

at least one rigid ring sealed about an exterior periphery of each said at least one elastomeric ring, an outermost of said at least one rigid rings being sealed to said component, said others of said at least one rigid rings being sealed within the inner periphery of another elastomeric ring, and said combined elastomeric rings and rigid rings forming a concentric structure of alternating elastomeric and rigid rings; and a central disc sealed within an interior periphery of an innermost one of said at least one elastomeric rings; said at least one elastomeric ring being elastically expandable and contractible in response to said pressurized fluid.

2. The ring diaphragm of claim 1 further comprising a one way check valve within said central disc, said check valve being adapted to permit fluid to flow through said central disc when fluid pressure on a first side of said central disc exceeds that on an opposite side.

3. The ring diaphragm of claim 2 further comprising displacement stops positioned on said outermost rigid ring to obstruct the path of motion of said concentric structure such that the range of motion of said concentric structure is limited.

4. The ring diaphragm of claim 3 wherein said other rigid rings contact said displacement stops in said outermost rigid ring such that dashpot cavities form between said elastomeric rings and said displacement stops.

5. The ring diaphragm of claim 4 wherein each of said dashpot cavities temporarily retains a volume of fluid.

6. The ring diaphragm of claim 4 wherein the number of said elastomeric rings is two.

7. The ring diaphragm of claim 6 wherein said elastomeric rings are made from a synthetic elastomer.

8. The ring diaphragm of claim 6 wherein said elastomeric rings are made from a natural rubber.

9. The ring diaphragm of claim 6 wherein the level of shear strain in said elastomeric rings does not exceed fifty percent.

10. The ring diaphragm of claim 2 further comprising:

said central disk having at least one cut-out therein; and said check valve comprising at least one valve flap positioned in said central disk cut out for sealing off and unsealing said cut-out in response to said fluid pressure.

11. The ring diaphragm of claim 10 wherein said at least one valve flap is pivotably attached to said central disc at said opposite side, said at least one valve flap resting against said at least one cut-out and pivoting about its point of attachment in response to said fluid pressure on said first side.

12. The ring diaphragm of claim 11 wherein said at least one valve flap is attached centrally on said central disc.

13. The ring diaphragm of claim 12 wherein the number of said valve flaps is two and the number of said cutouts is four.

14. A system for ejecting a projectile into a fluid medium comprising:

at least one cylindrical launch tube, each said tube having a longitudinal axis, a muzzle end, a breach end, and a slide valve near said breach end, said tube provided for housing said projectile and slidably guiding said projectile during said ejection;

an impulse tank in hydraulic communication with said slide valve, said impulse tank having peripheral walls with a diaphragm aperture formed therein;

an elastomeric ring diaphragm including at least one elastomeric ring and at least one rigid ring sealed about an exterior periphery of each said at least one elastomeric ring, an outermost of said at least one rigid rings being sealed to said impulse tank diaphragm aperture, said others of said at least one rigid rings being sealed within the inner periphery of another elastomeric ring, and said combined elastomeric rings and rigid rings forming a concentric structure of alternating elastomeric and rigid rings, said at least one elastomeric ring being elastically expandable and contractible in response to said pressurized fluid;

a central disc sealed within an interior periphery of an innermost one of said at least one elastomeric rings; and a pump means joined to said impulse tank for supplying pressurized fluid to said impulse tank whereby fluid pumped into said impulse tank causes said elastomeric ring diaphragm to elastically distend so that opening said slide valve releases pressurized fluid from said impulse tank into said launch tube.

15. The system of claim 14 further comprising a one way check valve within said central disc, said check valve being adapted to permit fluid to flow through said central disc when fluid pressure on a first side of said central disc exceeds that on an opposite side.

16. The system of claim 15 wherein said check valve comprises:

said central disk having at least one cut-out therein; and said check valve comprising at least one valve flap positioned in said central disk cut out for sealing off and unsealing said cut-out in response to said fluid pressure.

* * * * *